US006886203B2

(12) United States Patent
Drakos et al.

(10) Patent No.: US 6,886,203 B2
(45) Date of Patent: May 3, 2005

(54) MATTRESS LIFTER

(76) Inventors: Louis J. Drakos, 275 Gulfshore Blvd. N., Naples, FL (US) 34102; John P. Drakos, 26 Totoket Rd., Branford, CT (US) 06405

( * ) Notice: Subject to any disclaimer, the term of this patent is extended or adjusted under 35 U.S.C. 154(b) by 0 days.

(21) Appl. No.: 10/342,944

(22) Filed: Jan. 15, 2003

(65) Prior Publication Data

US 2004/0133985 A1 Jul. 15, 2004

(51) Int. Cl.[7] ..... A47C 21/06
(52) U.S. Cl. ..... 5/660; 5/488; 5/659
(58) Field of Search ..... 5/488, 509.1, 659, 5/660, 612, 634

(56) References Cited

U.S. PATENT DOCUMENTS

| | | | | | |
|---|---|---|---|---|---|
| 2,387,357 | A | * | 10/1945 | Rogerson | 5/660 |
| 3,259,921 | A | * | 7/1966 | Alsobrook, Jr. | 5/610 |
| 3,353,196 | A | * | 11/1967 | Guillon | 5/660 |
| 3,636,573 | A | * | 1/1972 | Bartz | 5/618 |
| 3,952,346 | A | * | 4/1976 | Carlson | 5/660 |

* cited by examiner

*Primary Examiner*—Michael Trettel
(74) *Attorney, Agent, or Firm*—Ted Paulding

(57) ABSTRACT

A mattress lifter having a base member and tubular lifting elements pivotably supported thereby. Handles at opposite ends enable the homemaker to lift the mattress with ease and convenience.

7 Claims, 4 Drawing Sheets

MATTRESS LIFTER

BACKGROUND OF THE INVENTION

Lifting a corner or end of a mattress in the process of making a bed may prove difficult especially in the case of an elderly housewife.

Accordingly, it is the general object of the present invention to provide a mattress lifter simple in its construction and operation and which can be manufactured at economic advantage.

SUMMARY OF THE INVENTION

In accordance with the present invention and in fulfillment of the foregoing object, a mattress lifter is provided with a base member adapted to reside on and across a box spring adjacent one end of a bed and beneath an associated mattress. A mattress lifting element is pivotably mounted on the base member and has operative elevated mattress lifting and inoperative prone positions.

At least one and preferably two(2) handles exposed at the sides of the mattress and box spring are provided and are connected with the lifting element and adapted for manual manipulation; movement of the handles in one and opposite directions respectively raising and lowering the lifting element and lowering the mattress.

Preferably, the mattress lifter is of tubular construction with small brackets mounting an integral lifting element and handle assembly for pivotal movement relative to the base member. Further, two(2) lifting elements are preferred in a single or twin bed model, three(3) elements in a double bed model, and four(4) elements in a queen or king size model. A four(4) element model may also be provided with one-half freely rotatable relative to the other half. Such a unit may find use in a king size bed made up of two twin beds positioned in side-by-side relationship.

DESCRIPTION OF PREFERRED EMBODIMENTS

Figure 1:
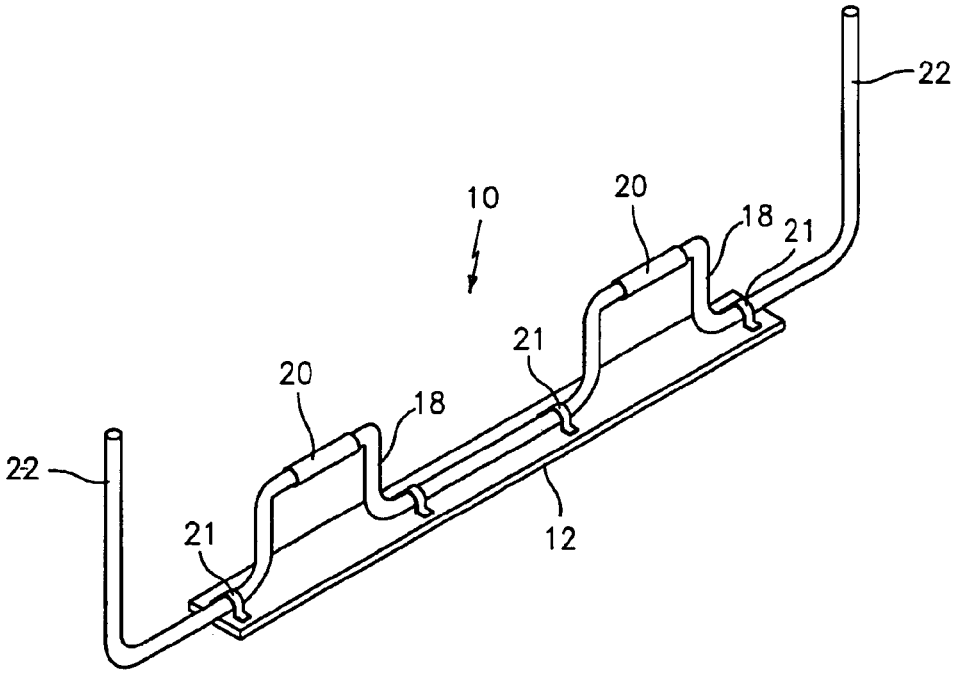
FIG. 1 is a perspective view of a twin size mattress lifter.
Figure 2:
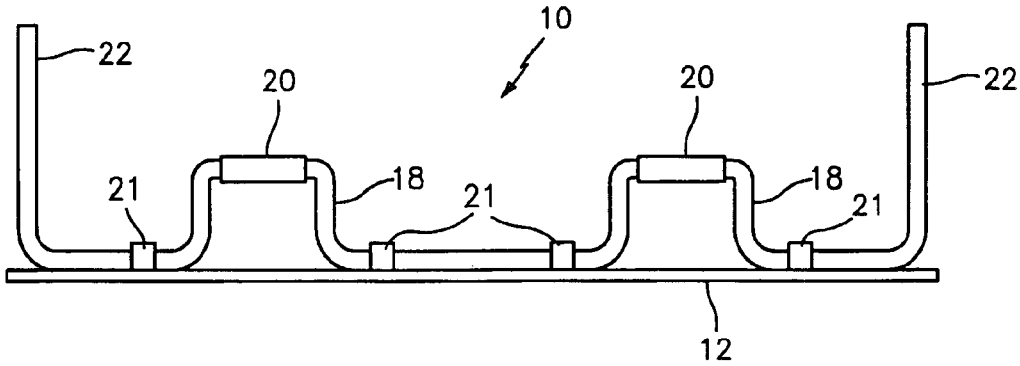
FIG. 2 is a side elevational view of the lifter of FIG. 1.

Referring particularly to FIGS. 1 and 2, a mattress lifter in accordance with the invention is shown in perspective at 10 with an elongated base member 12. The member 12 is intended to be placed on and across a base spring 14, FIG. 3, beneath a mattress 16. Coated metal, plastic or other suitable non-corrosive construction is acceptable.

Two (2) lifting elements 18,18 are provided on the lifter 10 and are spaced longitudinally along the base member 12.

The lifting elements 18,18 are preferably of integral tubular construction again of a non-corrosive metal or plastic and, as shown, an entire lifting and handle assembly is formed integrally of bent metal or molded tubing. Small slip-cover members 20,20 are preferably mounted respectively on the lifting members, which take a generally u-shaped configuration. Handles 22,22 at each end of the lifter extend transversely and are manually manipulated by the user as in FIGS. 3 and 4. The handles are of sufficient length relative to the lifting elements to provide a mechanical advantage as when the user may be an elderly homemaker. Pivoting action of the lifting elements is provided by brackets 21,21 which rotatably mount the tubing between the lifting elements 18,18 on the base member 12.

Figure 3:
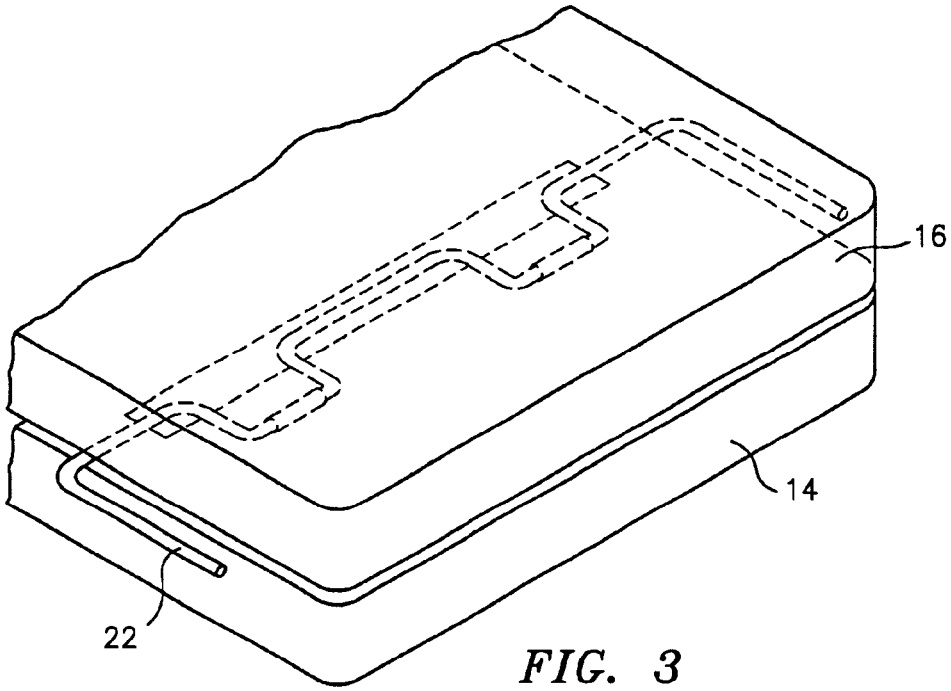
FIG. 3 is a perspective view of FIG. 1 lifter in position between a box spring and mattress with the mattress in a normal or flat attitude.
Figure 4:
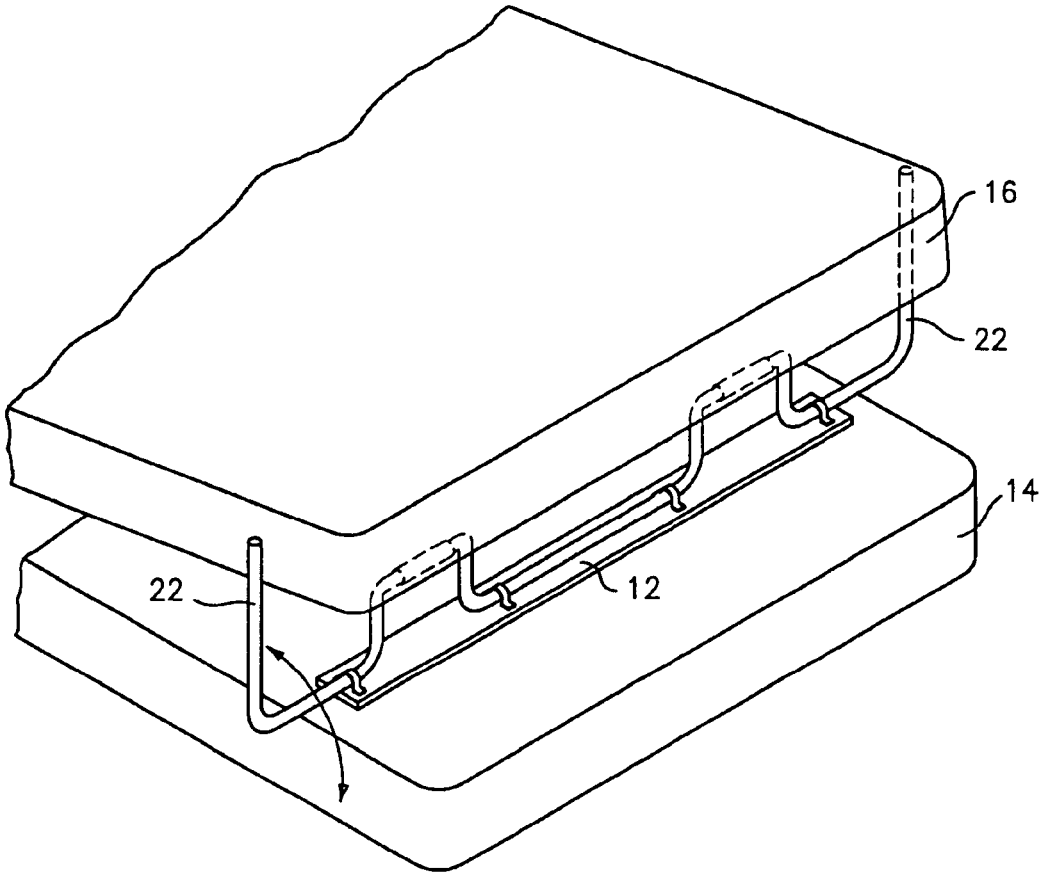
FIG. 4 is a view similar to FIG. 3 but with the lifter in an operative position elevating on end position of the mattress.

As will be apparent in FIGS. 3 and 4, the lifting elements have operative lifting and inoperative prone positions as effected by rotation of the handles 22,22.

Figures 5, 6:
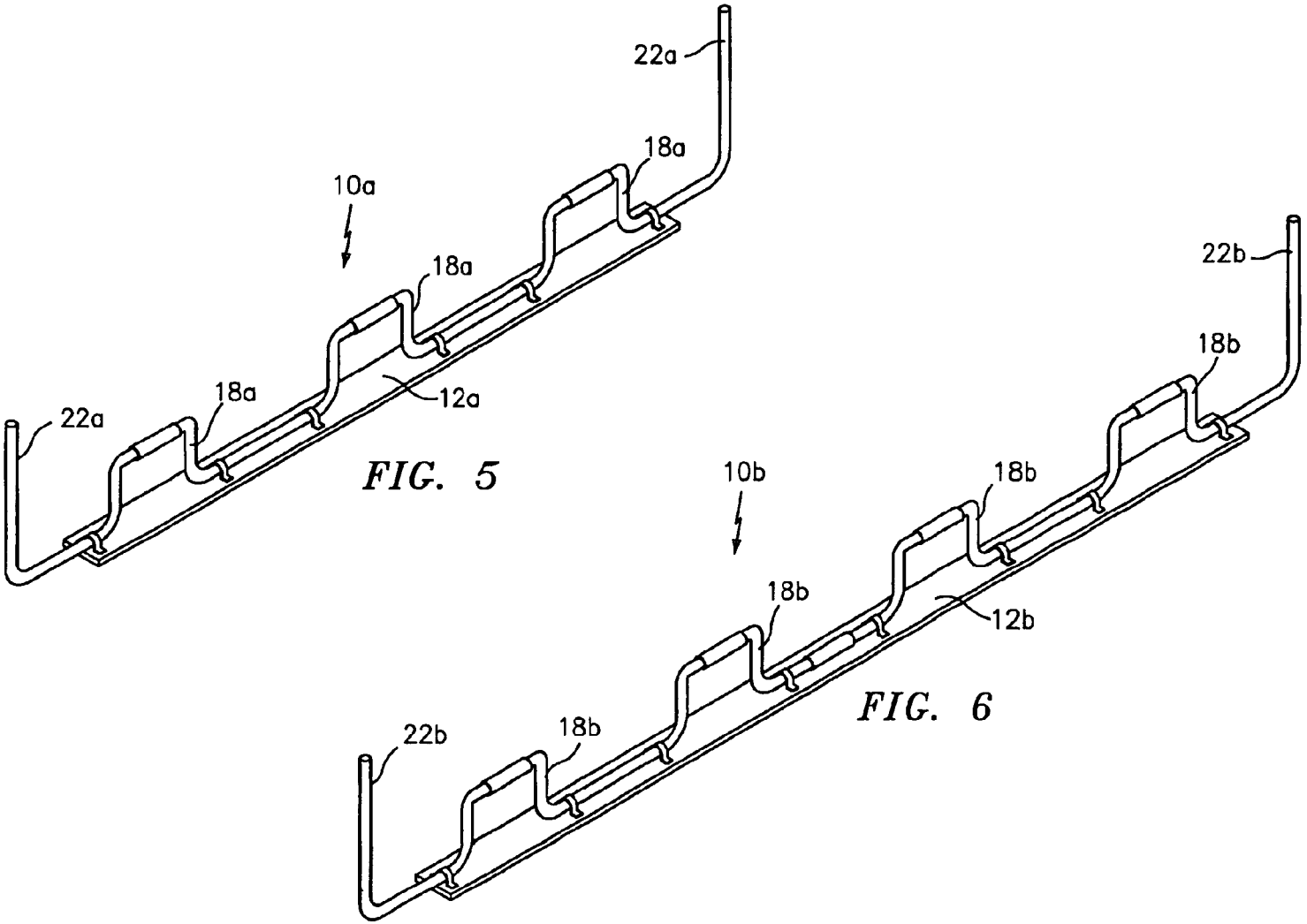
FIG. 5 is a perspective view of a three(3) lifting element double bed model of the lifter.
FIG. 6 is a perspective view of a four(4) lifting element model for queen or kind size beds.
Figure 7:
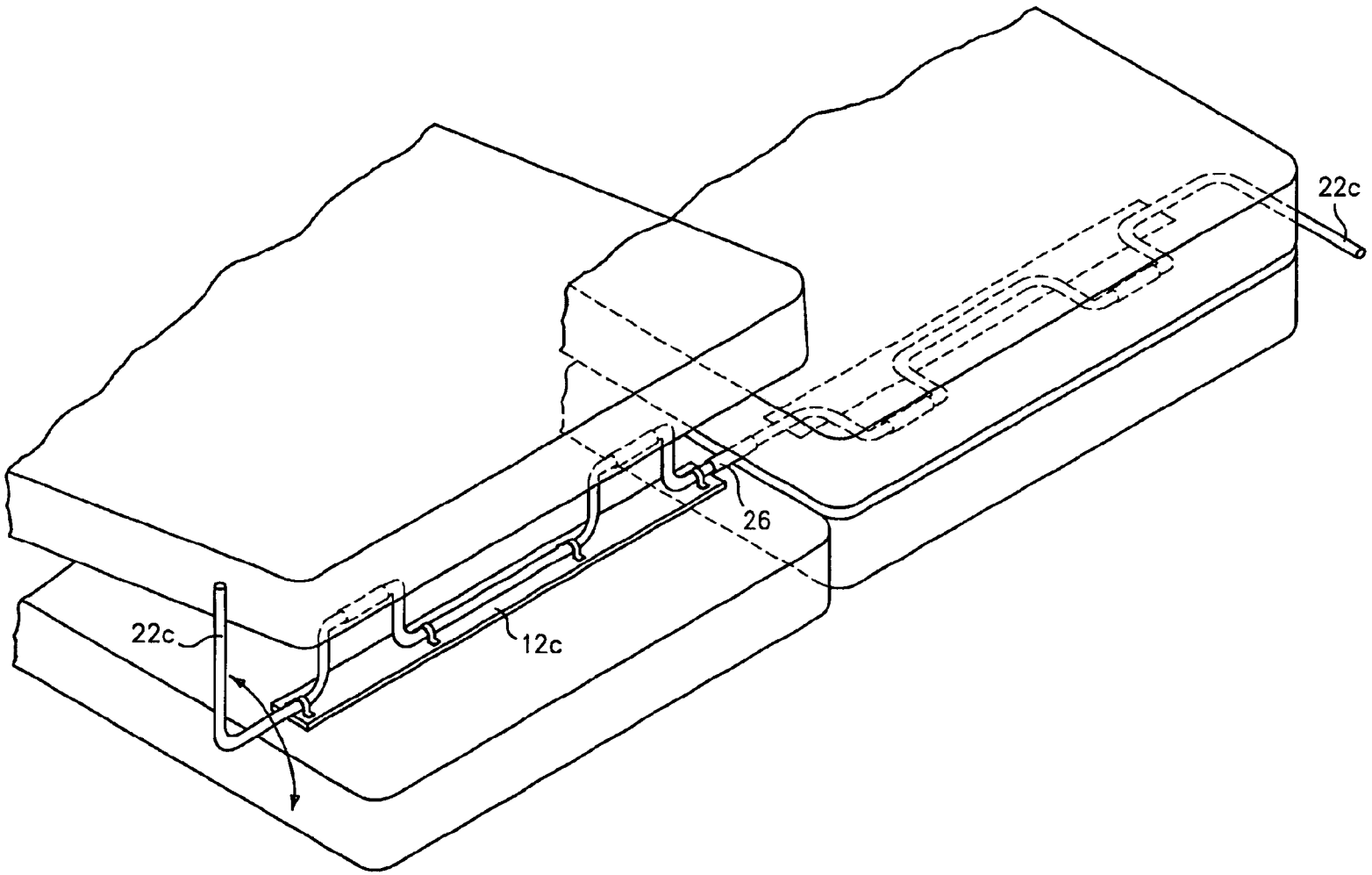
FIG. 7 is a perspective view of a kind size bed formed from side-by-side twin beds, the lifter having sections for ease in lifting one corner of the bed at a time.

FIGS. 5 and 6 respectively show lifters with three(3) and four(4) lifting elements for double and queen or king size beds. FIG. 7 also shows a four(4) element model but the tubing is provided with a small collar 26, which accommodates relative movement of each half of the lifter. This model may be particularly useful when lifting one corner of a heavy conventional king size mattress or one half of double twin king size mattress as illustrated.

As will be apparent from the foregoing, a simple device of inexpensive construction has been provided for assisting the homemaker in an everyday chore and hopefully rendering that chore less burdensome.

The invention claimed is:

1. A mattress lifter comprising a flat elongated base member adapted to reside on and across a box spring adjacent one end of a bed and beneath an associated mattress, at least one mattress lifting element pivotably mounted on the base member and having operative lifting and inoperative prone positions, and at least two handles adapted for manual manipulation exposed at opposite sides of an associated mattress and box spring and connected with the lifting element, movement of the handles in one direction serving to raise the mattress for insertion of sheets and blankets therebeneath and movement in an opposite direction serving to lower the mattress to its normal flat attitude.

2. A mattress lifter as set forth in claim 1 wherein a pair of spaced apart mattress lifting elements are provided.

3. A mattress lifter as set forth in claim 1 wherein the lifting element and handles are integrally formed of tubular material.

4. A mattress lifter as set forth in claim 1 wherein three (3) lifting elements are provided in spaced relationship across the mattress and wherein a handle is provided on each side of the mattress and box spring.

5. A mattress lifter as set forth in claim 1 wherein four (4) lifting elements are provided in spaced relationship across the mattress and wherein a handle is provided on each side of the mattress and box spring.

6. A mattress lifter as set forth in claim 1 wherein the lifting elements are provided in spaced relationship with each pair being operable independently.

7. A mattress lifter as set forth in claim 1 wherein small brackets are provided on the base member for pivotably mounting the lifting elements.

* * * * *